United States Patent [19]

Backstein et al.

[11] 4,311,097

[45] Jan. 19, 1982

[54] DUAL UNDERWATER SAFETY FUSE

[75] Inventors: Guenter Backstein, Meerbusch; Hans W. Unger, Krefeld, both of Fed. Rep. of Germany

[73] Assignee: Rheinmetall GmbH, Duesseldorf, Fed. Rep. of Germany

[21] Appl. No.: 83,386

[22] Filed: Oct. 10, 1979

[30] Foreign Application Priority Data

Oct. 11, 1978 [DE] Fed. Rep. of Germany ..... 2844188

[51] Int. Cl.[3] ..... F42C 3/00; F42C 5/00

[52] U.S. Cl. ..... 102/229; 102/223; 102/392; 102/416

[58] Field of Search ..... 102/223, 228, 229, 16

[56] References Cited

U.S. PATENT DOCUMENTS 3,015,270 1/1962 Domingos, Jr. et al. ..... 102/229

3,151,557 10/1964 Evanoff et al. ..... 102/229

3,195,460 7/1965 Kalaf ..... 102/16

3,368,488 2/1968 Johnson et al. ..... 102/229

4,056,058 11/1977 deRins ..... 102/16

*Primary Examiner*—Charles T. Jordan

[57] ABSTRACT

A fuse apparatus for a depth charge or the like has a primary fuse that operates at a relatively shallow depth to position a detonator in line with a firing pin, and a secondary fuse that operates to release the firing pin to explose the detonator. A safety mechanism normally prevents operation of the primary fuse, but can be canceled to allow such operation. The secondary fuse cannot itself operate until the primary fuse has operated, so that the two fuses must operate successively to set off the detonator. In addition the two fuses operate along mutually perpendicular axes, so accidental jarring of the device cannot set it off. Finally the arrangement is constructed to leak slightly so that in the event it fails to go off it will rapidly become inoperative.

18 Claims, 3 Drawing Figures

DUAL UNDERWATER SAFETY FUSE

FIELD OF THE INVENTION

The present invention relates to a pressure-actuated fuse apparatus. More particularly this invention concerns a safety fuse usable to set off a charge automatically at a predetermined underwater depth.

BACKGROUND OF THE INVENTION

It is frequently necessary to provide an explosive charge with a fuse that sets it off automatically when the charge is at a predetermined level. Although such a fuse can operate in accordance with barometric pressure to set off a charge when a certain altitude has been reached, it is more common for this type of fuse to find application underwater. Thus the fuse is provided on a depth charge usable in military operations, or on a charge used for generating shocks to make seismographs for geological or underwater-prospecting tasks.

The key requirements for such a fuse are that it operate surely to detonate the charge except when this level is reached. Thus elaborate precautions are take to prevent arming of the charge or operation of the fuse before use, and to prevent the charge from going off except under the exact desired circumstances. Furthermore it is essential that the fuse not detonate the charge when for some reason circumstances are not what they should be, as when the explosive is dropped in water which is insufficiently deep to activate the fuse but which later becomes deeper, as when the tide comes in, or when some part of the fuse mechanism fails.

A classic prior-art fuse can be seen in U.S. Pat. No. 4,056,058 issued Nov. 1, 1977 to Fernando Almarza Laguna de Rins. This device has a firing member which can be released to strike against a detonator by mechanism controlled by a diaphragm. The diaphragm is urged outwardly by a spring which holds it in a blocking position inhibiting movement of the firing member, but can be pressed inwardly by fluid pressure from outside. Thus if the fuse is dropped in the water the increasing pressure on the outside of the diaphragm will eventually overcome the spring force and free the firing member to detonate the primer.

Such an arrangement has the advantage of simple mechanism, and can easily be adjusted to go off at virtually any desired depth. Some disadvantages do remain, however. First of all, if the fuse is jarred or dropped so that a strong component of force is effective on the membrane and the associated structure in a direction displacing it inwardly, the fuse will operate. Secondly, the diaphragm is relatively exposed so that it can be damaged easily, making the device inoperative. Finally, virtually any fault in assembly or construction can make the device go off accidentally.

OBJECTS OF THE INVENTION

It is therefore an object of the present invention to provide an improved fuse apparatus.

Another object is to provide such an apparatus which is safer than the known devices.

A further object is the provision of a fuse which, when armed, will surely detonate at the desired pressure, but which will never go off otherwise.

Yet another object of this invention is to provide a fuse which cannot be set off by jarring in any direction, and which will automatically disarm itself after being submerged for a limited time in the event that it for some reason does not detonate.

SUMMARY OF THE INVENTION

The objects of the invention are attained according to the present invention in a dual safety fuse having respective actuating elements that move along respective and transverse axes between inner and outer positions. Springs and air pressure inside the housing of the apparatus according to this invention urge the actuating elements into the outer positions, and water or air pressure outside the housing can displace them into the inner positions. The pressure at which the one actuating element, normally the secondary one, moves into the respective inner position is greater than that sufficient to move the other element into the respective inner position so that the two elements will move sequentially into the inner positions as the pressure outside the apparatus increases. Primary link means prevents the secondary element from moving into the inner position except when the primary element is in the inner position, and secondary link means prevents the firing member of the apparatus from engaging and exploding the detonator or primer charge except when the secondary element is in the inner position.

Thus if the apparatus according to this invention is jarred or otherwise given a sudden shock, it is impossible for this shock to move both of the actuating elements into the respective inner positions. Since both of the actuating elements must be in the inner positions for the detonator to be fired, this means that even very rough treatment of the fuse device according to this invention cannot set it off. Furthermore the sequential operation of the primary and secondary fuses ensures that the apparatus will arm itself in successive stages as it reaches the pressure at which it is to go off.

According to another feature of this invention the detonator or primer charge itself is carried on a holder fixed on the primary element and movable jointly therewith between a misaligned position in which the firing member cannot engage and fire it and corresponding to the outer position of the primary element, and an aligned position corresponding to the inner position of the primary element and aligned with the firing member. Thus even if some vital part of the mechanism is left out on assembly of the apparatus or fails at a subsequent date, the detonator will simply normally be out of harm's way so that accidental displacement of the firing member will not be able to explode it.

In accordance with yet another feature of the present invention the actuating elements are formed in part as diaphragms defining respective primary and secondary inner compartments in the housing. A passage in the housing interconnects the inner compartments, and may connect them to a pressure-equalization compartment also, but otherwise the housing is generally sealed so that an air cushion in the housing acts as part of the spring means that bias the two diaphragms outwardly. A limitedly pervious plug, of felt for example, has one side exposed to the passage and another side exposed to the outside, so that if the fuse apparatus is submerged for a long time without operating, seepage through this plug will eventually allow water to fill the inner compartments, thereby making inward deflection of the diaphragms virtually impossible so that the device is rendered inoperative. Thus an explosive charge equipped with the fuse according to this invention does not represent a long-lived hazard in the event it fails to fire.

The housing according to this invention forms with each of the diaphragms an outer compartment that is open to the outside through small flow-permitting apertures. A sieve plate in each outer compartment between the respective diaphragm and the respective outer housing wall has perforations that are out of line with the apertures in the housing wall. Thus accidental or intentional introduction of a pointed object into one of the apertures cannot result in piercing of the respective diaphragm.

The primary link means according to this invention is the tip of the secondary actuating element. The primary element is formed relative to the primary axis with a pair of axially spaced and radially open bores, one shallow and one deep, connected by an axially extending groove. The tip of the secondary element is engaged in the shallow bore in the outer position of the primary element, and may slide along the groove and engage in the deep bore in the inner position of the primary element. When thus engaged in the deep bore the secondary element can move along its respective axis into its inner position to release the spring-loaded firing member to strike the detonator.

The secondary link means of this invention is largely constituted by a ball displaceable relative to the secondary axis between a freeing position engaged in a recess of the secondary element and out of engagement with the firing member, and a blocking position engaging the secondary element adjacent this recess and engaging the firing member in such a manner as to hold it against displacement by its spring toward the detonator. Shifting of the secondary element along its axis can align the ball with the recess so that a frustoconical shoulder on the firing member can press the ball to the side and let the firing member explode the detonator which by this time has been aligned with it. A non-spherical element, for example a pin, could, of course, replace the ball.

Although the fuse apparatus according to this invention is described as primarily for use in setting off some sort of underwater depth charge, it could easily be set up to operate an aerial bomb or the like. Furthermore the spring constants could be reversed so that the device sequentially arms itself as the surrounding pressure decreases rather than increases.

SPECIFIC DESCRIPTION

Figure 1:
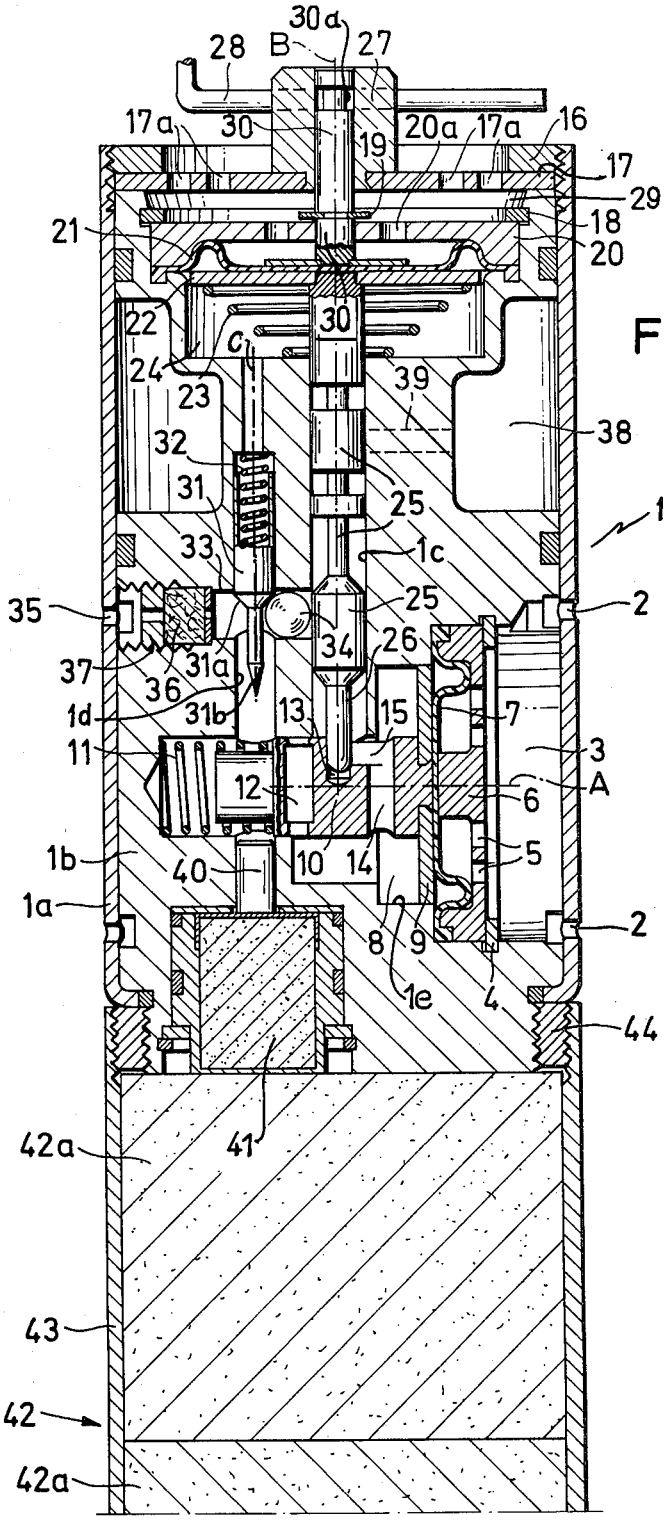
FIG. 1 is an axial section through the apparatus according to the instant invention in the fully unactuated and safety positions.

As seen in the drawing a fuse apparatus 1 according to this invention has a cylindrical outer housing sleeve 1*a* fitting tightly around a core 1*b* formed with a stepped central bore 1*c* centered on axis B, a second offcenter stepped bore 1*d* centered on an axis C, and a transverse or perpendicular stepped bore 1*e* centered on an axis A perpendicular to the axis B. The sleeve 1*a* is formed centered on the axis B with an annular array of primary apertures 2 opening into the outer edge of a primary outer compartment 3.

A snap ring 4 in this compartment 3 holds a sieve plate 6 formed centered on the axis A with an annular array of bores 5 which are spaced radially inwardly of the apertures 2. A diaphragm 7 is held between this sieve plate 6 and a shoulder of the stepped bore 1*e* and defines on its side opposite the outer compartment 3 a primary inner compartment 8. An actuating element 10 movable axially in the bore 1*e* bears via a plate 9 on the diaphragm 7 for displacement thereby. A compression spring 11 bears on the opposite end of the element 10 which is formed as a holder for a detonator charge 12. In addition the element 10 is formed with a blind shallow bore 13 perpendicular to the axis A and with a deep throughgoing bore 14 spaced axially from it, with an axially extending groove 15 connecting the two bores 14 and 15. These bores 14 and 15 can be aligned with the axis B as will be apparent below. The structure of elements and formations 4–15 therefore constitutes the primary fuse according to this invention.

A threaded retainer ring 16 in the upper end of the sleeve 1*a* holds an outer plate 17 formed with an annular array of apertures 17*a* against the upper end of the core 1*b*. A snap ring 18 holds another sieve plate 20 beneath this plate 17, with perforations 20*a* of the plate 20 being spaced radially well inside the apertures 17*a*. Another diaphragm 21 pinched between the plate 20 and a shoulder of the stepped bore 1*c* defines with the plate 17 an outer compartment 29. The diaphragm 21 bears via a plate 22 on a secondary actuating element 25 formed as a stepped rod in the bore 1*c*, with a compression spring 23 biasing the plate 22 and diaphragm 21 upwardly and outwardly. The diaphragm 21 therefore also forms an inner compartment 24 with the housing core 1*b*, with the inner compartments 8 and 24 communicating with each other through a passage formed by the bore 1*c* and groove 15. The structure of elements and formations 16–18 and 20–25 therefore constitutes the secondary fuse according to this invention.

A short pin 30 centered on the axis B is reciprocal in a block 27 fixed to the plate 17 and is provided with a snap ring 19 that limits its downward travel along the axis B. The lower end of this pin 30 bears via the diaphragm 21 on the upper end of the secondary actuating element 25. The pin 30 is formed adjacent its upper end with a circumferential groove 30*a* that can be engaged by a safety pin 28 formed as a cotter pin and serving to lock the pin 30 axially in place against the upwardly effective force of the spring 23. A separate spring could of course be provided to urge the pin 30 upwardly.

The actuating element 25 has a small-diameter axially projecting tip 26 constituting a primary link means for the primary actuating element 10. This tip 26 can fit within either of the bores 13 or 14 to lock the element 10 in place. When the pin 30 is retained in the position of FIG. 1 the tip 26 is held forcibly in the shallow bore 13 to axially lock the element 10. When the safety pin 28 is withdrawn, however, the spring 23 pushes up the pin 30, so that it projects some 3 mm from above the knob 27, allowing the element 25 to rise slightly and pull the tip 26 out of the hole 13 to allow the element 10 to move axially.

A firing pin 31 is slidable along the axis C of the bore 1*d* of the housing and has a pointed tip 31*b* that can engage and explode the detonator 12. The firing member 31 is continuously biased downwardly by a spring 32 toward the element 10, and has a frustoconical shoulder 31*a*. A ball 34 constituting secondary link means is displaceable along a bore 33 of the core 1*b* between the FIG. 1 position engaging under the shoulder 31*a* and blocking downward displacement of the pin 31 and engaging the side of the element 24 and the FIG. 2 position engaging in a circumferential recess 25*a* of the element 25 and axially clear of the pin 31.

The end of the bore 33 is covered by a felt plug 36 held in place by a threaded ring 37 and the housing sleeve 1*a* is formed with an aperture 35 that opens into the end of this bore 33. The felt plug 36 is generally water-impervious and gas-pervious, but will allow water and gas to seep through itself in time.

The housing is formed with a pressure-equalization compartment 38 connected via a passage 39 to the central bore 1*c*, and otherwise all the bores and inner compartments are inter connected for pressure equalization. The only way fluid can enter the various bores and inner compartments is through the plug 36.

A priming charge 41 is aligned with the bore 1*d*, with a force-transmitting member 40 serving to transmit the energy of the explosion of the detonator 12 to this priming charge. A depth charge 42 with bursting charges 42*a* has a sleeve 43 secured via a threaded ring 44 to the lower end of the core 1*b*, so that explosion of the primer charge 41 in turn set off the charges 42*a*.

Figure 3:
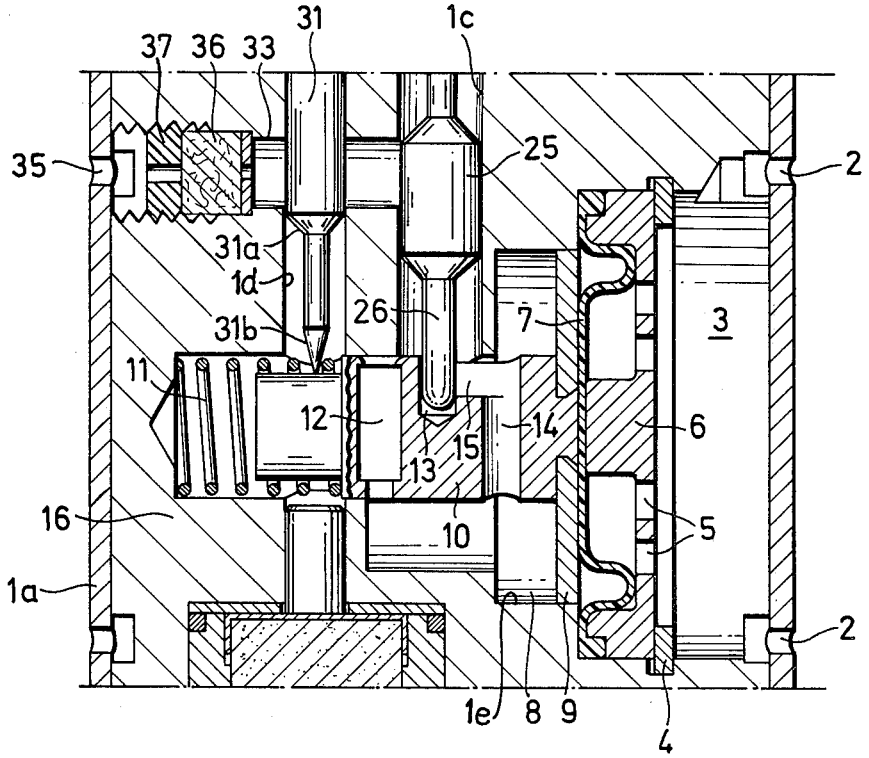
FIG. 3 is a detail view similar to FIG. 2 showing what happens in the device if a critical piece of its mechanism is omitted.

During transit and storage the various parts of the inventive structure are in the positions shown in FIG. 1. The two diaphragms 7 and 21 are in their outer positions, with the actuating element 10 being locked in its outer position by the link means constituted by the tip 26. Furthermore, since the tip 26 of the element 25 is engaged in the shallow bore 13, axial displacement of this element 25 out of the outer position is impossible. The detonator 12 is out of line with the firing pin 31 so that even in the event of some highly unlikely occurrence, such as misassembly of the device which omits the ball 34 constituting the secondary link means, the pin 31 cannot strike the detonator 12 as shown in FIG. 3. If the device is subjected to a severe shock in any direction, the detonator 12 will not be fired since both of the diaphragms 7 and 21, which move along mutually perpendicular axes, must be moved to their inner positions from the outer positions illustrated in FIG. 1 to set off the detonator 12.

Figure 2:
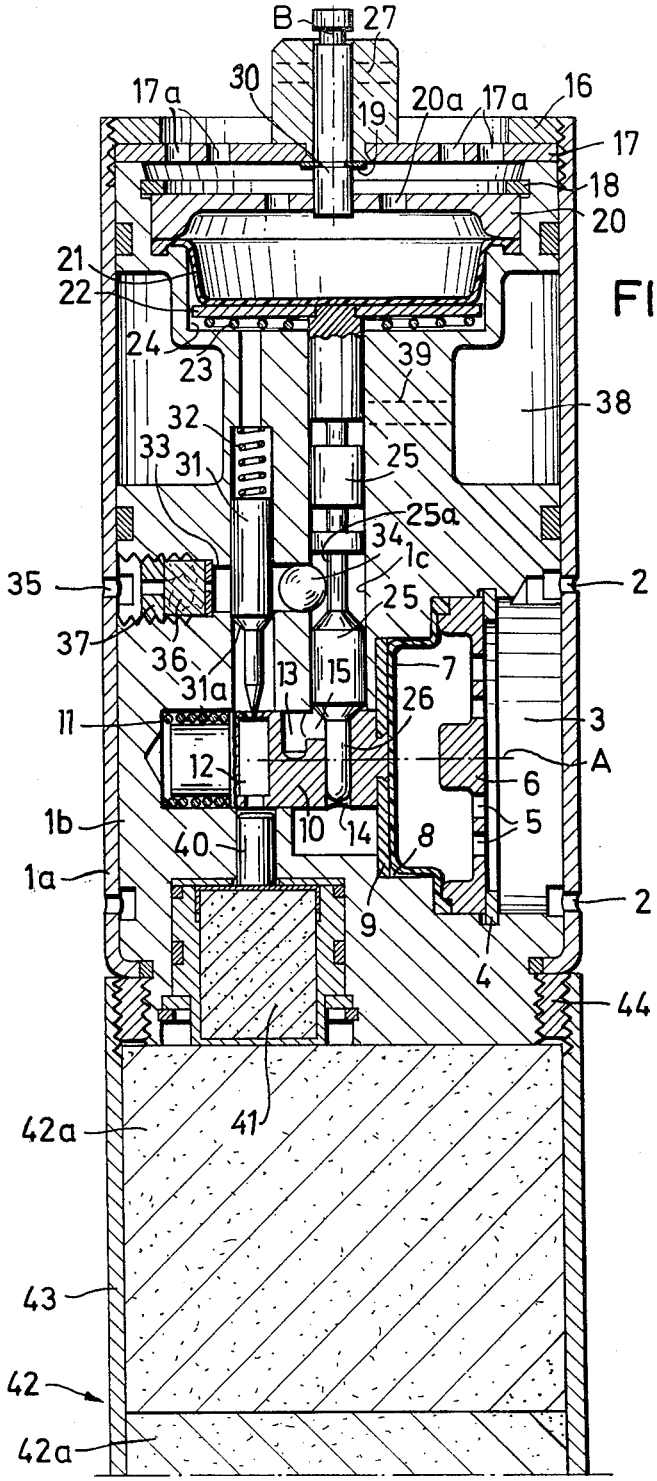
FIG. 2 is a view simlar to FIG. 1 showing the apparatus in the fully actuated and ready positions.

The device is armed by withdrawal of the safety pin 28 as seen in FIG. 2. This action causes the pin 30 to project somewhat, giving a clear indication that the device is armed. If after arming the device the user changes his or her mind and wishes to return it to safety, the pin 30 need merely be depressed again and the pin 28 reinserted to restore it to the safety position. In this safety position the element 25 is forcibly held down so that its tip 26 locks the element 10 axially in place while the ball 34 is forced under the shoulder 31*a* of the pin 31.

After arming the device is normally dropped into water somewhat deeper than the depth at which it is set to go off, in a typical arrangement the charges 42*a* should explode at a depth of 5 m. Once dropped into the water the pressure in the outer compartments 3 and 29 will increase, while that within the inner compartments 8 and 24 will remain the same. The force of compression spring 11 is somewhat smaller than that of the spring 23 so that at a depth of about 2 m the diaphragm 7 will move from the outer FIG. 1 position to the inner FIG. 2 position, thereby aligning the tip 26 with the deep and throughgoing bore 14 and simultaneously aligning the detonator 12 with the pin 31. As the device continues to descend the increasing pressure at a depth of 4 m to 5 m will be effective on the diaphragm 21 to move the element 25 downwardly. Once the ball 34 is radially aligned with the recess 25*a*, the spring 32 will cam this ball 34 out of the way with the shoulder 31*a* and the tip 31 will strike forcibly against the detonator 12. The detonator 12 will explode and the force of this explosion will be transmitted through the element 40 to the primer charge 41 to set it off and to in turn set off the bursting charges 42*a*.

Assuming something goes wrong, as for example the device is dropped into water that is insufficiently deep to operate the secondary fuse, one of the fuses or the firing member becomes jammed, one of the charges fails to explode, or the like, within a short time of being submerged there will have been sufficient leakage through the felt plug 36 to completely fill the interior of the apparatus with water. As water is largely incompressible, the various parts of the mechanism will become unable to move. Thus, for example, if the charge is dropped at low tide, when the tide comes in it will not go off, even if the depth differential is enough to actuate the secondary fuse. Being filled with water will also in the long term render the device completely inoperative as the springs 11, 23, and 32 will rust out and the various charges 12, 41, and 42*a* will become soaked. Thus the device can normally be counted on to become inoperative and over the long term will be completely harmless.

The apparatus according to the invention is therefore safe at all times. The offset apertures and holes 17*a*, 20*a*, and 2, 5 prevent accidental or intentional piercing of the diaphragms 7 and 21. The pin 30 will obviously project whenever the safety is off so that accidents in this regard are unlikely, and the safety can even be reset if desired. The fuse can easily withstand very rough handling, and even misassembly or parts failure is unlikely to set it off. In use the two-stage fusing ensures that the detonator will go off at exactly the desired depth. In the event the device does not explode, it will rapidly render itself permanently inoperative.

What is claimed is:

1. A pressure-actuated fuse apparatus comprising: a housing forming primary and secondary compartments; respective primary and secondary fuses including primary and secondary actuating elements exposed in the respective compartments and displaceable along respective primary and secondary axes in said housing between outer and inner positions, said axes being transverse, and primary and secondary spring means braced between said housing and said primary and secondary elements for urging same into their outer positions and for permitting same to move into their inner positions when the respective compartments are at respective primary and secondary pressures, said pressures being substantially different from each other;

a detonator mounted in said housing;

a firing member in said housing displaceable into a firing position engaging and exploding said detonator;

primary link means for blocking said secondary element from moving into the respective inner position except when said primary element is in the respective inner position; and secondary link means for blocking said firing member from moving into said firing position except when said secondary element is in the respective inner position.

2. The apparatus defined in claim 1, further comprising a holder carrying said detonator and connected to said primary element for joint movement therewith between a misaligned position out of line and unengageable with said firing member and corresponding to said out position of said primary element and an aligned position in line and engageable with said firing member and corresponding to said in position of said primary element.

3. The apparatus defined in claim 2 wherein said axes are generally perpendicular.

4. The apparatus defined in claim 2 wherein said primary and secondary elements include respective primary and secondary membranes defining with said housing respective primary and secondary inner compartments.

5. The apparatus defined in claim 4 wherein said secondary pressure is substantially greater than said primary pressure.

6. The apparatus defined in claim 4 wherein said housing forms with said primary and secondary membranes respective outer primary and secondary compartments and is formed at said compartments with throughgoing apertures.

7. The apparatus defined in claim 6 wherein said housing includes primary and secondary perforated plates in said outer compartments between the respective membranes and the respective apertures and having perforations out of line with the respective apertures, whereby a sharp object projecting through one of said apertures cannot pass through one of the respective perforations and pierce the respective membrane.

8. The apparatus defined in claim 4, further comprising safety means including a safety member operable from outside said housing between a safe position operatively engaging one of said elements and retaining same in the respective outer position, and a ready position permitting said one element to move into the respective inner position.

9. The apparatus defined in claim 8 wherein in said safe position said safety member is generally flush with said housing and in said ready position said safety member projects from said housing.

10. The apparatus defined in claim 8 wherein said one element is said primary element and said safety member is engageable through said secondary element with said primary element.

11. The apparatus defined in claim 4 wherein said primary and secondary spring means include respective primary and secondary compression springs in said primary and secondary inner compartments and braced between said housing and the respective membranes.

12. The apparatus defined in claim 11 wherein said housing forms a passage between said inner compartments and otherwise is generally sealed, whereby air pressure in said compartments constitutes part of said spring means urging said membranes outwardly.

13. The apparatus defined in claim 12, further comprising means for permitting water outside said housing to seep at a controlled rate into said compartments, whereby, if said detonator is not fired when said apparatus is used underwater, water will seep into said compartments and largely disable said spring means.

14. The apparatus defined in claim 13 wherein said means for permitting water to seep into said compartments includes a felt-type plug having one side exposed in said passage and another side exposed to water outside said housing.

15. The apparatus defined in claim 4 wherein said primary element is formed with a relatively short blind bore aligned in said outer position of said primary element with said secondary axis and with a relatively long bore aligned in said inner position of said primary element with said secondary axis, said primary link means being a tip on said secondary element and engageable in said bores.

16. The apparatus defined in claim 15 wherein said primary element is formed with a shallow groove extending along said primary axis between said bores, said tip riding along said groove on displacement of said primary element between said inner and outer positions.

17. The apparatus defined in claim 4 wherein said secondary element is formed with a recess open radially of said secondary axis, said secondary link means including a ball displaceable between a blocking position engaging radially against said secondary element adjacent said recess and blocking displacement of said firing member into said firing position, and a freeing position engaged in said recess and permitting said firing member to move into said firing position.

18. The apparatus defined in claim 4 wherein said housing forms another compartment and is formed with at least one passage connecting said other compartments with said inner compartments, whereby the air pressure captured in said compartment and in said passage constitutes part of said spring means.

* * * * *